US006783852B2

(12) United States Patent
Inada et al.

(10) Patent No.: US 6,783,852 B2
(45) Date of Patent: Aug. 31, 2004

(54) HIGH-ABSORBENT POLYVINYL ALCOHOL FIBERS AND NONWOVEN FABRIC COMPRISING THEM

(75) Inventors: Shinya Inada, Okayama (JP); Satoru Kobayashi, Okayama (JP); Junichi Taniguchi, Okayama (JP); Suguru Mizuki, Okayama (JP); Hideki Kamada, Okayama (JP); Masakazu Nishiyama, Okayama (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 10/648,449

(22) Filed: Aug. 27, 2003

(65) Prior Publication Data

US 2004/0059055 A1 Mar. 25, 2004

(30) Foreign Application Priority Data

| | | |
|---|---|---|
| Aug. 30, 2002 | (JP) | 2002-253447 |
| Mar. 10, 2003 | (JP) | 2003-063203 |
| Mar. 10, 2003 | (JP) | 2003-063204 |

(51) Int. Cl.[7] ..... D01F 6/00; D01M 10/00

(52) U.S. Cl. ..... 428/364; 428/394; 8/115.51; 264/185; 264/291; 264/307

(58) Field of Search ..... 428/364, 394; 8/115.51; 264/185, 291, 307

(56) References Cited

U.S. PATENT DOCUMENTS

| | | | | |
|---|---|---|---|---|
| 6,066,396 | A | 5/2000 | Inada et al. | 428/370 |
| 6,235,063 | B1 * | 5/2001 | Nakayama et al. | 8/115.56 |

FOREIGN PATENT DOCUMENTS

| | | |
|---|---|---|
| JP | 1192815 | 8/1989 |
| JP | 3014613 | 1/1991 |
| JP | 7189023 | 7/1995 |

* cited by examiner

*Primary Examiner*—N. Edwards
(74) *Attorney, Agent, or Firm*—Oblon, Spivak, McClelland, Maier & Neustadt, P.C.

(57) ABSTRACT

Cross-linked polyvinyl alcohol fibers prepared from a water-soluble polyvinyl alcohol, which satisfy the following requirements:

(1) a water absorption in water at 30° C. ranging from 10 to 100 times the weight of the fibers;

(2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g.

16 Claims, No Drawings

HIGH-ABSORBENT POLYVINYL ALCOHOL FIBERS AND NONWOVEN FABRIC COMPRISING THEM

BACKGROUND OF THE INVENTION

1. Field of the Invention

The present invention relates to polyvinyl alcohol (hereinafter abbreviated as PVA) fibers of good absorbency, and to a nonwoven fabric comprising them.

2. Description of the Prior Art

In the past, polyacrylates have been typically used in the preparation of high-absorbent fibers. Based on their characteristics, they are widely used in various fields of sanitary materials, medical goods, electromechanical materials, food-wrapping materials, agricultural materials, construction materials, and the like. However, the high-absorbent fibers of this type have some problems in that they are weak by themselves and therefore can not substantially placed into practical use when alone, and, in addition, their workability is not good and they are expensive.

As to fibers prepared from PVA, the hydroxyl groups in the PVA molecules form intramolecular and intermolecular hydrogen bonds and the bonds are firm enough to prevent intramolecular and intermolecular water penetration. In water at room temperature, therefore, no change in the morphology of the fibers is found and they absorb little water. Given this situation, various studies have been conducted with the objective of making such PVA fibers highly absorbent. For example, one approach is to mix spin a highly-absorbent resin with PVA as discussed in JP-A 1-192815, which discloses that when a highly-absorbent polymer prepared by introducing a crosslinking structure into an alkali metal salt of a copolymer of an α-olefin or a vinyl compound with maleic anhydride is spun with PVA by mix spinning the materials, highly-absorbent PVA fibers result. However, in the method of production described in the patent publication, a blend of PVA with a highly-absorbent polymer that does not form fibers by itself is used and therefore the strength of the fibers produced is low, that is, lower than 1 cN/dtex. Another problem with the method is that the crosslinking reaction time for heat treatment is long and the running cost is therefore high.

On the other hand, for example, JP-A 3-014613 discloses that dry spinning of a carboxylic acid-modified PVA gives PVA fibers having a water absorption of 100 times by weight or more. However, since the degree of carboxylic acid modification of PVA of these fibers is high, that is, from 9 to 15 mol %, the costs of the PVA fibers are high. Another problem with the method is that, because the properties of the fibers are not good, the fibers often present problems in working them into fibrous structures such as nonwoven fabrics. JP-A 7-189023 discloses examples of spinning a self-crosslinkable PVA polymer or introducing a crosslinking structure into non-self-crosslinkable PVA fibers to make the fibers absorbent. By this method, however, the draw ratio of the fibers can not be increased up to 3 times or more, and therefore the strength of the fibers is low. In addition, because the crystallinity of the PVA polymer is high, the water absorption of the fibers is approximately 1 time and is low. Further, because no catalyst is used in manufacture of the fibers, the crosslinking reaction takes a long time and the running cost is therefore high.

On the other hand, some ordinary water-soluble PVA fibers prepared from PVA that has a low degree of hydrolysis or is copolymerized with a hydrophilic group may swell in water at room temperature, but their water absorption is less by a factor of than 10 times. Accordingly, these fibers can not be high-absorbent fibers, and therefore can not be used for the manufacture of nonwoven fabrics that are required to have a high water absorption.

As so mentioned hereinabove, producing PVA fibers of high absorbency presents problems in that the absorbency of the fibers produced is low, the productivity of the fibers is low and the production costs are high, and when nonwoven fabrics comprising the fibers are produced, the physical properties such as strength and elongation of the fibers are unsatisfactory, and the problems with them therefore interfere with the practical use of the fibers. Given this situation, there is a continuing need to develop highly-absorbent PVA fibers that solve the known problems and to prepare nonwoven fabric prepared from such fibers.

SUMMARY OF THE INVENTION

Accordingly, one object of the present inventors is to provide PVA fibers of high water absorbency and that have good strength and elongation properties and from which fabrics containing the fibers can be readily prepared.

Briefly, this object and other objects of the present invention as hereinafter will become more readily apparent can be attained by cross-linked polyvinyl alcohol fibers prepared from a water-soluble polyvinyl alcohol, which satisfy the following requirements:

(1) a water absorption in water at 30° C. ranging from 10 to 100 times the weight of the fibers;

(2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g.

DETAILED DESCRIPTION OF THE PREFERRED EMBODIMENTS

It has now been discovered that when a crosslinking component is introduced into a water-soluble PVA polymer in the presence of a catalyst within a short period of time in an ordinary spinning step not requiring any specific step and when the overall draw ratio of the fibers in the drawing step is a factor of at least 3, then highly-absorbent PVA fibers can be obtained inexpensively and the fibers thus obtained naturally have good absorbency and have good fiber properties that are necessary for fibrous structures such as nonwoven fabrics. In addition, we have found that, when the method of processing them is suitably selected, then the wet dimension of the nonwoven fabrics comprising the fibers can be controlled, and therefore the nonwoven fabrics are especially suitable for fibrous structures that are required to have good adhesiveness. We have further found that, when a specific crosslinking component is introduced into PVA, then biodegradable, highly-absorbent PVA fibers are prepared inexpensively that dissolve in boiling water at 98° C.

Preferably, a cross-linking component that is capable of forming a hydrogen bond and/or an ester bond or an ether bond in the PVA is introduced into the PVA fibers, and the degree of cross-linking of the fibers ranges from 0.01 mol % to 1 mol %. Also preferably, the crosslinking component introduced into the PVA fibers is a silane monomer or oligomer of the following formula (I), or a polyacrylic acid or a salt of polyacrylic acid. The resulting fibers dissolve to an extent of at least 90% in boiling water at 98° C.

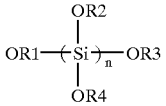

(I)

In the formula, $R^1$ to $R^4$ each independently represent hydrogen, an alkyl group having from 1 to 5 carbon atoms, or an acetyl group, and n ranges from 1 to 10.

The invention also provides a method for producing the PVA fibers of the invention by introducing a cross-linking agent and/or a cross-linkable polymer into a water-soluble PVA polymer through reaction in any of drying, drawing and heat-treating steps. The polymer is dissolved in a spinning solvent or an extraction solvent in the presence of a catalyst in any stage from the polymer-dissolving step to the drying step. The process is so controlled that the overall draw ratio of the fibers in the drawing step is at least 3 times. The invention also provides a nonwoven fabric prepared from the cross-linked PVA fibers of the invention. The fabric has a PVA fiber content preferably ranging from 5 to 100% by weight and which has an area retention when wet, preferably ranging from 20 to 120%.

The highly-absorbent PVA fibers of the invention are characterized by having a high water absorption at room temperature. As will be described hereinunder, the high absorbency of the fibers is attained by introducing a crosslinking structure into PVA fibers that are soluble in room-temperature water. The polymer that constitutes the fibers must be a water-soluble PVA. In the case where the water-soluble PVA polymer is a partially-saponified PVA in which the units except the vinyl alcohol units are vinyl acetate units, the polymer preferably has a degree of saponification of smaller than 97 mol %, or that is, the vinyl acetate unit content of the polymer is preferably at least 3 mol %. However, if the degree of saponification is 80 mol % or less, the fibers produced will undesirably exhibit self significant agglutination. Moreover, the spinnability of the polymer is not good.

In the case where a modified PVA polymer contains additional monomer units other than the vinyl alcohol units and the vinyl acetate units are used and where the modifying units have the significant effect of inhibiting crystallization of the polymer, then the modified PVA polymer of the type that has a degree of modification of around 0.5 mol % may be favorably used in the invention. In general, however, the degree of modification of the modified PVA polymers for use in the invention is preferably at least 1 mol %, more preferably at least 2 mol %. The modified PVA polymer of the type may be soluble in room-temperature water because of its crystallization-inhibiting ability, even when its degree of saponification is not less than 97 mol %. Depending on the degree of modification and the modifying units therein, even those having a vinyl acetate unit content of less than 1 mol % may be used herein so far as their degree of saponification is so controlled that they are soluble in room-temperature water. On the other hand, however, when the modifying unit content of the modified PVA polymer is greater than 20 mol %, the polymer is not satisfactory because the crystallinity of the polymer will be significantly less and, in addition, the physical properties of the fibers produced will be poor and the spinnability of the polymer will also be poor.

Examples of modifying units include ethylene, allyl alcohol, itaconic acid, acrylic acid, vinylamine, maleic anhydride and its ring-cleaved derivatives, sulfonic acid group containing vinyl compounds, vinyl esters of fatty acids having at least 4 carbon atoms such as vinyl pivalate, vinylpyrrolidone, and compounds derived from them by partially or completely neutralizing the ionic groups therein. The introduction of the modifying units may be accomplished by any mode of copolymerization or after-reaction. With no specific limitation thereon, the modifying units may be distributed in the polymer chain in any way such as in a random fashion or in blocks or by grafting. Though not specifically defined, the degree of polymerization of the polymer is preferably at least 1000, more preferably at least 1500 in view of the mechanical properties and the absorbency of the fibers, but is preferably at most 4000 in view of the polymer spinnability into fibers.

The highly-absorbent PVA fibers of the invention may be obtained by introducing a cross-linking component into the water-soluble PVA polymer having the composition as described above. The absorbency of the PVA fibers of the invention may be indicated by the water absorption thereof. It is important that the water absorption of the PVA fibers of the invention in water at 30° C. range from 10 to 100 times by weight. If their water absorption is smaller than 10 times by weight, the fibers will be difficult to use for applications that require absorbency. On the other hand, while fibers having a water absorption of larger than 100 times by weight can be produced representing a clear increase in the ability to absorb moisture, nevertheless, their strength is too low. Therefore, when such fibers are formed into a fibrous structure such as nonwoven fabrics, their productivity will be poor. Preferably, the water absorption of the PVA fibers of the invention falls between 15 and 80 times by weight, more preferably between 20 and 50 times by weight.

Depending on the cross-linking component introduced into the polymer and on the degree of cross-linking achieved, the solubility of the PVA fibers of the invention in boiling water at 98° C. may be controlled in any desired manner. For example, for non-woven fabrics that are required to have good adhesiveness, preferred are highly-absorbent PVA fibers that are prepared by introducing a cross-linking component that is capable of forming a hydrogen bond and/or an ester bond or ether bond into a water-soluble PVA polymer. Preferably, the solubility of the PVA fibers of the type falls between 5 and 50%. If the solubility is higher than 50%, the basic structure of the non-woven fabrics formed from the fibers will be deformed, thereby losing its commercial value. In addition, the quantity of highly-absorbent PVA fibers will decrease as they dissolve away, and, as a result, the structural absorbency of non-woven fabrics will diminish. Still another problem is that, when the non-woven fabrics are dried after they have absorbed water, then the dissolved fibers will be pasty and, as a result, the nonwoven fabrics themselves will be sticky. On the other hand, if the solubility of the fibers is less than 5%, then the degree of saponification of the starting PVA polymer must be increased or the degree of cross-linking must be increased. With it, however, the absorbency of the resulting PVA fibers will decrease to less than 10 times by weight and the fibers will be of no use for highly-absorbent performances.

In the case where the cross-linking component that is capable of forming a hydrogen bond and/or an ester bond or an ether bond is introduced into the above-mentioned water-soluble PVA polymer thereby resulting in highly-absorbent PVA fibers, the degree of cross-linking of the fibers preferably ranges from 0.01 mol % to 1 mol %. If the degree of crosslinking is less than 0.01 mol %, the fibers will still be soluble in water even at room temperature and therefore can not satisfy the object of the invention. On the other hand, if the degree of cross-linking is greater than 1 mol %, fibers having a water absorption of not less than 10 times by weight can not be obtained. Preferably, the degree of cross-linking of the fibers of the invention ranges from 0.05 to 0.5 mol %, more preferably from 0.1 to 0.3 mol %. For example, the degree of cross-linking of the PVA fibers that are obtained by introducing an ether bond-forming cross-linking component into the polymer may be determined according to the method described in the section of Examples below.

On the other hand, for the fibrous structures that are not incinerated when they are disposed and that are required to be biodegradable, for example, those that have marine use and those that are used for sanitation or for cultivating seedlings, it is desirable that the PVA fibers dissolve to the extent of at least 90% in boiling water at 98° C. while their absorbency is still on the same level as described above. Introducing a crosslinking agent of a silane monomer or oligomer of the following formula (I) or a polyacrylic acid or a salt of polyacrylic acid into a water-soluble PVA polymer may result in PVA fibers that have the intended characteristics. In particular, when a silane monomer or oligomer of the following formula (I) is used and when the Si content of the PVA fibers with at least one terminal of the silane monomer or oligomer bonding thereto is at least 50 ppm, then the silane monomer or oligomer is dissociated from the PVA fibers in boiling water at 98° C. and, as a result, the PVA fibers dissolve to an extent of at least 90% in boiling water even though they are insoluble in water at room temperature. The cross-linking condition of the silane monomer or oligomer to the PVA fibers may be confirmed by the assignment of the peak shift for the number of the bonding siloxanes determined by $^{29}$Si—NMR, or by the Si content of the silane monomer or oligomer-crosslinked PVA fibers determined by fluorescent X-ray spectrometry.

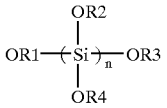

(I)

wherein $R^1$ to $R^4$ each independently represents hydrogen, an alkyl group having from 1 to 5 carbon atoms, or an acetyl group, and n is from 1 to 10.

The PVA fibers of the invention must have low crystallinity, that is, have a heat of fusion ranging from 40 to 100 J/g and a melting point ranging from 160 to 220° C. If the fibers have a heat of fusion larger than 100 J/g and a melting point of higher than 220° C., the crystallinity of the fibers is too high. This means that, in the fibers, the amorphous part that is pervious to water is small, and therefore the fibers can not be the highly-absorbent fibers of the invention. Preferably, the heat of fusion of the PVA fibers of the invention ranges from 40 J/g to 70 J/g and their melting point ranges from 160° C. to 210° C.

In addition, the diameter of the highly-absorbent PVA fibers of the invention that are in water at 30° C. to absorb water must expand from 2 to 10 times that of the fibers not having absorbed water. The fibers that may expand and absorb water by themselves to that extent enables their water absorption ranging from 10 to 100 times by weight. More preferably, the diameter of the fibers may range from 4 to 8 times, even more preferably from 5 to 7 times that of the dry fibers.

A suitable method by which the fibers of the present invention are produced is as follows. A water-soluble PVA polymer is dissolved in water or an organic solvent to prepare a spinning liquid. The liquid is spun into fibers according to the method described below. The method is efficient and the fibers thus produced have good mechanical properties and good absorbency. Needless-to-say, the spinning liquid may contain any other additive and polymer than that above that does not interfere with the advantages of the invention. The solvent for the spinning liquid includes, for example, water; polar solvents such as DMSO, dimethylacetamide, dimethylformamide, N-methylpyrrolidone; polyalcohols such as glycerin, ethylene glycol; mixtures of these solvents with swelling metal salts such as rhodanates, lithium chloride, calcium chloride, zinc chloride; mixtures of these solvents; and mixtures of these solvents with water. Of these solvents, water and DMSO are the best because of the low-temperature solubility of these solvents and because of their low toxicity and low corrosion properties.

The polymer concentration in the spinning liquid varies depending on the composition, the degree of polymerization and the solvent, but preferably ranges from 8 to 40% by weight. The temperature of the spinning liquid that is being spun preferably falls within a range within which the spinning liquid does not gel and does not degrade and discolor. Desirably, the spinning temperature ranges from 50 to 150° C.

The spinning liquid in its condition is spun through a nozzle by either wet or dry spinning, into a coagulating bath having the ability to coagulate the PVA polymer. In particular, when the spinning liquid is spun through multiple orifices, wet spinning is preferred to dry/wet spinning because it prevents the spun fibers from agglutinating together. In the wet spinning method, the spinning liquid is directly spun through a spinneret into a coagulation bath, while in the dry/wet spinning method, the spinning liquid is once spun through a spinneret into air or into an inert gas and then led into a coagulation bath.

In the invention, different coagulation baths may be used in the case where the spinning solvent is an organic solvent and in the case where the spinning liquid is an aqueous solution. For the spinning liquid that comprises an organic solvent, preferred is a mixture of a coagulation solvent and a spinning solvent in view of the mechanical strength of the fibers produced. The coagulation solvent may be an organic solvent having the ability to coagulate PVA polymer. For example, it includes alcohols such as methanol, ethanol; and ketones such as acetone and methyl ethyl ketone. Especially preferred is a mixed solvent of methanol and DMSO. Preferably, the ratio by weight of coagulation solvent/spinning solvent in the coagulation bath ranges from 25/75 to 95/5, more preferably from 55/45 to 80/20 from the view points of productivity and solvent recovery. Also preferably, the coagulation bath temperature is not higher than 30° C., more preferably not higher than 20° C., even more preferably not higher than 15° C. from the view point of uniform cooling for gellation.

On the other hand, when the spinning solution is an aqueous solution, the coagulation solvent for the coagulation bath is preferably an aqueous solution of an inorganic salt having the ability to coagulate PVA polymer, such as Glauber's salt, sodium chloride, sodium carbonate. Naturally, the coagulation bath may be acidic or alkaline.

Next, the spinning solvent is removed from the thus-solidified fibers through extraction. During extraction, the fibers should preferably be wet drawn in order to prevent the fibers from agglutinating while drying and for increasing the strength of the fibers. Preferably, the wet draw ratio ranges from 2 to 6 times. The extraction may be effected by leading the fibers generally through multiple extraction baths. For the extraction bath, usable A suitable coagulating solvent may be used alone in the bath or a mixture of a coagulating solvent and a spinning solvent may be used. The extraction bath temperature may range from 0 to 50° C.

Next, the fibers are dried, whereby the intended PVA fiber product of the invention is obtained. In the invention, preferably a cross-linking agent, a cross-linkable polymer and a catalyst are dissolved in the spinning solvent or the extraction solvent in any stage from the step of preparing the spinning liquid to the step of drying the fibers, thereby introducing the cross-linking component into the fibers. Preferably, the cross-linking agent for use in the invention is soluble in the spinning solvent and the extraction solvent in order to efficiently and thoroughly disperse the cross-linking agent in the fibers. In the case where the cross-linking agent is to be in the spinning liquid, it may be added to and dissolved in the spinning solvent along with the substances to be dissolved therein while the spinning liquid is prepared. In this case, it may be added thereto before or after the PVA polymer is dissolved in the solvent. An inactivator that acts to prevent the cross-linking reaction during the preparation of the spinning liquid may be added to the system of preparing the spinning liquid with no problem. On the other hand, when the cross-linking agent is to be present in the extraction solvent, it may be added to and dissolved in the extraction bath for introduction into the fibers. The fibers from which the spinning solvent has been extracted are led into the extraction bath before they are dried. In this case, it is important that the fibers in the extraction bath swell therein in order that the cross-linking agent may be uniformly dispersed in the fibers. For this purpose, it is desirable that the extraction bath be an alcohol such as methanol.

While the type of cross-linking agent is not specifically limited, the cross-linking agent usually is one that is capable of reacting with the hydroxyl group in the PVA polymer. For example, such cross-linking agents include aldehydes, epoxy compounds, carboxylic acids, isocyanates and silanols. Of these materials, preferred are dialdehydes and their diacetals, such as glutaraldehyde, nonanedial, 1,1,9,9-tetramethoxynonane, 1,1,9,9-bis(ethylenedioxy)nonane, 1,1,4,4-tetramethoxybutane, 1,1,5,5-tetramethoxypentane, dimethoxytetrahydrofuran and dimethoxytetrahydropyran, in view of their reactivity. On the other hand, when the cross-linking agents are required to be soluble in hot water, preferred are alkoxysilanes such as tetramethoxysilane, tetraethoxysilane, tetrabutoxysilane, their acetic acid-substituted derivatives and their hydrolyzed oligomers, and carboxylic acid-containing polymers such as polyacrylic acid and polymethacrylic acid and their salts. The amount of the cross-linking agent to be added may suitably determined depending on the necessary absorbency and solubility in hot water of the fibers. For example, when aldehydes are used for the cross-linking agent, then the amount of cross-linking agent preferably ranges from 1 to 20 g/liter, more preferably from 2 to 10 g/liter. On the other hand, when alkoxysilanes are used as the cross-linking agent, then the amount used preferably ranges from 0.1 to 50 g/liter, more preferably from 1 to 20 g/liter. The crosslinking agent may be used by itself, or it may be used for modifying the PVA polymer or any other polymer to be added to the spinning liquid.

In the case where the cross-linking agent is used together with a cross-linking catalyst in the extraction bath, the molecules of the cross-linking agent may polymerize in the bath. In this case, therefore, diacetals are preferred. In diacetals that serve as the crosslinking agent in this case, the aldehyde site is acetalized. Therefore, even though the cross-linking agent of the type is together with the cross-linking catalyst in the extraction bath, its molecules do not polymerize. For the protective group to acetalize aldehydes in order to protect them, for example, preferred are alcohols such as methanol, ethanol; and glycols such as ethylene glycol. However, when aldehydes are protected with alcohols or glycols, the crosslinking structure is formed in the fibers in the step of drying, drawing or heating the fibers, as will be so mentioned hereinunder. In this case, therefore, it is desirable that the protective group be easily removed with heat for better cross-linkability with the agent, and the easily-removable protective group enables low-temperature cross-linking with the agent. For these reasons, methanol having a low molecular weight is favored as the protective group. Anyhow, it is desirable that the protective group be suitably selected and used depending on the necessary physical properties of the fibers to be produced and on the conditions by which they are produced.

Thus introduced into the fibers, the cross-linking agent reacts therein during or after spinning of the fibers, whereby the PVA fibers thus produced may have good absorbency or may have both good absorbency and solubility in hot water. In the case where the fibers are cross-linked while they are formed, a cross-linking catalyst may be dissolved in the coagulation or extraction bath for introduction into the fibers, and the fibers may have a cross-linked structure formed therein as a result of being heated in the step of drying or drawing. For the cross-linking reaction, the type and the amount of the crosslinking catalyst to be used may be suitably selected. Preferably, the cross-linking catalyst is soluble in the extraction solvent, like the cross-linking agent. Regarding the type of the catalyst, any of organic acids, e.g., carboxylic acids, sulfonic acids and inorganic acids, e.g., sulfuric acid, hydrochloric acid may be used with no specific limitation thereon. For preventing apparatus corrosion, preferred are organic acids that are weak acids to inorganic acids that are strong acids. However, acids having an extremely small dissociation constant are not desirable, since the amount thereof necessary for the intended cross-linking reaction increases which causes an increase in production costs. Organic acids that are preferred for use herein are organic carboxylic acids such as maleic acid, citric acid; and organic sulfonic acid such as p-toluenesulfonic acid. Preferably, the amount of the cross-linking catalyst to be added ranges from 0.01 to 50 g/liter, more preferably from 0.1 to 30 g/liter.

A hydrophilic group may be introduced into the PVA fibers in the extraction bath. In order to accomplish this, compounds having a hydrophilic group and having a functional group capable of reacting with the hydroxyl group in the PVA fibers are used. Upon reaction with this type of compound, the PVA fibers may have a hydrophilic group introduced thereinto via an acetal bond, an ether bond or an ester bond. Suitable such compounds include, for example, aldehyde group containing carboxylic acids such as o-carboxybenzaldehyde, p-carboxybenzaldehyde; acetal group containing sulfonic acids such as o-benzaldehydesulfonic acid, o,p-benzaldehydedisulfonic acid, 7-formyl-1-heptanesulfonic acid ethylene acetal; and/or their alkali metal salts. A compound of this type is placed in the substitution bath along with the above-mentioned cross-linking agent and acid catalyst, and the PVA fibers are dipped into the bath, and then dried, drawn and heated. In these steps, the compound reacts with the fibers with heat and the intended hydrophilic group is thereby introduced into the fibers via an acetal bond. One or more of these compounds may be used herein either singly or as combined. Needless-to-say, it is possible to attain both cross-linking and hydrophilization of the fibers at the same time by the use of a cross-linking agent that has a hydrophilic group such as that mentioned above. In case where such a hydrophilic group is introduced into PVA polymer by any method mentioned above, the amount of the hydrophilic group containing compound to be introduced into the polymer may vary in any desired manner that does not have an adverse influence on the spinnability of the PVA polymer and on the melting point of the PVA fibers. Specifically, the amount preferably ranges from 0.01 to 20 mol %, more preferably from 0.5 to 15 mol %.

After the extraction step and the substitution step, the fibers are dried. In the case where both the cross-linking component and the cross-linking catalyst have been applied to the fibers before the drying step, a cross-linked structure is formed in the fibers in the drying step and in the drawing and heating step after the drying step. If desired, an oily agent may be applied to the fibers being dried. Preferably, the drying temperature is not higher than 210° C. More preferably, the fibers are dried in a multi-stage drying mode in which they are dried at a low temperature not higher than 160° C. in the initial stage of drying but at a high temperature in the latter stage thereof In order to further improve the mechanical properties of the fibers, it is desirable that the fibers be drawn while exposed to dry heat at a temperature ranging from 150 to 250° C. in such a controlled manner that the overall draw ratio of the fibers is at least 3 times, more preferably at least 5 times. The overall draw ratio of at least 3 times enables the drawn fibers to have a strength ranging from 1.5 to 4.0 cN/dtex, and the overall draw ratio of at least 5 times enables the drawn fibers to have a strength of 4.0 cN/dtex or more. In this connection, when ordinary absorbent PVA fibers are drawn to an overall draw ratio of 3 times or more, their absorbency diminishes. In contrast to the conventional absorbent PVA fibers, the highly-absorbent PVA fibers of the invention are completely cross-linked before the end of the drying step, and therefore, when they are crystallized in the subsequent drawing step, the cross-linked structure therein interferes with the crystallization of the fibers and, as a result, even though they are drawn to an overall draw ratio of 3 times or more, their absorbency does not decrease. This is one characteristic feature of the fibers of the invention. The overall draw ratio as referred to herein is represented by the product obtained by multiplying the wet heat draw ratio by the dry heat draw ratio.

Although not specifically limited, the fineness of the fibers of the invention may range, for example, widely from 0.1 to 10000 dtex, preferably from 1 to 1000 dtex. The fineness of the fibers may be suitably controlled by varying the nozzle diameter or the draw ratio.

The PVA fibers of the invention may be used in any form, for example, as cut fibers, filaments, spun yarns, strings, ropes or fibrils. If desired, the fibers may be worked into fabrics, for example, non-woven fabrics, woven fabrics or knitted fabrics. Especially for use in the field where they are desired to have high absorbency, non-woven fabrics are more preferred.

When the PVA fibers of the invention are worked into non-woven fabrics, any known method for preparation of non-wovens may be used. Specifically, any needle-punching method, embossing method, method of heating a mixture of thermally-fused fibers (through embossing, or with hot air, or in molds), binder-bonding method, water-jetting method, method of bonding nonwoven fabrics produced through melt-blowing or spun-bonding, or combination of these methods may be used. In accordance with the intended quality of the nonwoven fabrics to be produced, desired methods may be suitably selected.

The content of the PVA fibers of the invention in the nonwoven fabric preferably range from 5 to 100% by weight. If the content is less than 5% by weight, then the non-woven fabrics may be difficult to use in the field where they are required to have good absorbency. Since the highly-absorbent PVA fibers of the invention have good fiber properties such as thermal compressibility and good tenacity and elongation, non-woven fabrics of 100% highly-absorbent PVA fibers of the invention may be produced through embossing or needle-punching. However, in accordance with the intended quality and cost of the fibrous products, the PVA fibers may be combined with any other fibers. For example, they may be mixed or layered with any natural fibers such as pulp or cotton; regenerated fibers such as rayon or cupra; semi-synthetic fibers such as acetate or promix; and synthetic fibers such as polyester fibers, acrylic fibers, polyamide fibers (nylon, aramid) or low-absorbent PVA fibers. If desired, the non-woven fabrics of the invention may be combined with any other material such as a film, metal, resin and others.

Preferably, the wet area retention of the non-woven fabric of the invention ranges from 20 to 120%. The wet area retention may be controlled to range from 20 and 120% by suitably selecting the content and the method of production of the highly-absorbent PVA fibers or by combining them. Suitably controlling the wet area retention to fall within the range enables desired product planning in accordance with the necessary quality of products, for example, making it possible to improve the field-workability of products or making it possible to use products in the field where the products are required to have good adhesiveness. To enlarge the wet area retention, the content of the highly-absorbent PVA fibers is reduced, or the PVA fibers are subjected to water-jet treatment, or they are mixed with thermally-fusible fibers, then needle-punched or embossed, and thereafter exposed to hot air. These methods increase the entanglement of the constitutive fibers and are effective for this purpose. If desired, these methods may be combined. For reducing the wet area retention contrary to this, the content of the highly-absorbent PVA fibers is increased, or needle-punching or embossing alone is employed for producing the non-woven fabrics. These methods are effective for the purpose. More preferably, the wet area retention is from 40 to 100%. The wet area retention as referred to herein is determined according to the method described in the section of the Examples.

The highly-absorbent PVA fibers of the invention may be formed of a water-soluble PVA polymer that does not require any specific treatment. A cross-linking component is introduced into the PVA polymer within a short period of time in the presence of a catalyst in an ordinary spinning process, which yields the intended highly-absorbent fibers. Thus produced, the PVA fibers have good absorbency and have good fiber properties that are necessary for fibrous structures such as non-woven fabrics. Suitably selecting the processing methods for the non-woven fabrics of the fibers enables dimensional control in wet, worked fibrous products, and the products are especially suitable for use in areas where they are required to have good adhesiveness. For fibrous products that are not incinerated when they are disposed and that are required to be biodegradable, for example, those for marine use and those that are treated in waste treatment plants, the invention provides highly-absorbent PVA fibers that are capable of dissolving to an extent of at least 90% in boiling water at 98° C., by suitably selecting the type of the cross-linking agent to be used.

Having generally described this invention, a further understanding can be obtained by reference to certain specific examples which are provided hereinafter for purposes of illustration only and are not intended to be limiting unless otherwise specified.

In the following Examples, the water absorption, the solubility and the strength of the fibers; the degree of crosslinking of the PVA fibers with a cross-linking component to form an ether bond being introduced thereinto; the assignment of the condensation number, n, and the Si content of alkoxysilanes bonding to the PVA fibers which have, as the cross-linking component introduced therein, silane monomer or oligomer; the diameter expansion ratio of the fibers having absorbed water; the melting point and the heat of fusion of the fibers; and the water retention ratio and the wet area retention of the nonwoven fabrics were measured and evaluated according to the methods mentioned below. Water Retention (times):

About 0.25 g of the fibers to be analyzed is accurately weighed (A), and then dipped in 100 cc of water at 30° C. for 10 minutes. Next, the water treated fibers are filtered through a 14-mesh sieve, left as is for 5 minutes, and the mass (B) of the residue on the sieve is measured. On the other hand, the water content (C) of the fibers is measured. The water retention of the fibers is calculated according to the following equation:

$$\text{Water retention (times)}=<<B-[A\times(100-C)/100]>>/<<A\times(100-C)/100>>.$$

Solubility (%):

About a 0.5 g quantity of the fibers to be analyzed is accurately weighed (A), and then dipped in 100 cc of boiling distilled water at 98° C. for 30 minutes. Next, the water treated fibers are filtered through filter paper, then dewatered through centrifugation and dried in a hot air drier at 105° C. for 8 hours. The dried fiber mass (B) is calculated. On the other hand, the water content (C) of the fibers is measured. The solubility of the fibers in boiling water at 98° C. is calculated according to the following equation:

$$\text{Solubility (\%)}=<<[A\times(100-C)/100]-B>>\times100/<<A\times(100-C)/100>>.$$

Fiber Strength (cN/dtex):

Measured according to JIS L1013.

Degree of Crosslinking (mol %):

A sample of PVA fibers having been cross-linked through ether bonding for analysis is introduced is placed in a test tube along with 100 times by weight, relative to the sample, of aqueous 1-N hydroxylammonium chloride solution. The test tube is then sealed. The sample is processed at 121° C. for 2 hours to dissolve the sample. The resulting solution is titered with aqueous 0.1-N NaOH solution until it reaches the pH of the aqueous 1-N hydroxylammonium chloride solution. Based on the titration data, the degree of cross-linking of the PVA is calculated according to the following equation:

$$\text{Degree of cross-linking (mol \%)}=[\text{amount of alkali to neutralization (mol \%)}/(\text{weight of } PVA\ (g)/44)]\times½.$$

Assignment of the condensation number, n (ppm), and Si content (ppm) of alkoxysilane bonding to PVA fibers:

The cross-linked condition of the PVA fibers having, as the cross-linking component introduced thereinto, a silane monomer or oligomer is confirmed according to the following methods (1), (2):

(1) Assignment of the Condensation Number, n, of Alkoxysilane Bonding to PVA Fibers (ppm):

Using a high-resolution $^{29}$Si—NMR (JEOL's JNM-FX270), the condensation number, n, of the alkoxysilane bonding to the PVA fibers is assigned from the peak shift that indicates the siloxane-bonding number.

| Chemical Shift | N | Structure |
|---|---|---|
| −80 ppm | 1 | —Si—OH or —Si—$OCH_3$ |
| −85 ppm | 2 | =Si—O—Si |
| −103 ppm | 3 | =Si—$(O—Si)_2$— |
| −108 ppm | 4 | —Si—$(O—Si)_3$— |

(2) Si Content (ppm):

Using a fluorescent X-ray spectrometer (Rigaku Electric Industry's Fluorescent RIX3100), the Si content of the sample analyzed is derived from the peak area. Expansion Ratio of Fibers having Absorbed Water (Times):

A yarn to be analyzed is absolutely dried at 105° C. for 3 hours and processed to disperse the constitutive single fibers dispersed. The fibers are placed on a slide. With a Nikon's optical microscope, OPTIPHOT-2, the side surfaces of the fibers are observed and photographed at a magnification of 50. Next, a few drops of distilled water are applied to the sample and then covered, and this is again observed and photographed at the same magnification. On the picture, the fiber thickness is measured at 20 points randomly extracted, and the data are averaged to give the fiber diameter. Based on the thus-calculated fiber diameter, the expansion ratio of the fibers having absorbed water is calculated according to the following equation:

$$\text{Expansion ratio of fibers having absorbed water (times)}=[\text{fiber diameter after water absorption } (\mu m)/\text{fiber diameter before water absorption } (\mu m)].$$

Melting Point (° C.) and Heat of Fusion (J/g) of Fibers:

Using a TA Instrument's DSC (controller, TA5000; module, 2010DSC), the sample is measured in a nitrogen atmosphere at a heating rate of 20° C./min. The peak point at which the sample melted is the melting point (° C.); and the heat of fusion (J/g) is calculated from the fusion peak area.

Water Retention Ratio of Nonwoven Fabric (Times):

A sample of 10 cm×10 cm of the non-woven fabric to be analyzed is accurately weighed (A), and then dipped in water at 30° C. for 10 minutes. Next, the fabric is left under a load of 5 kg for 1 minute to express water from it, and its weight (B) is measured. The water retention ratio of the sample is calculated according to the following equation. On the other hand, the water content (C) of the non-woven fabric is measured.

$$\text{Water retention ratio (times)}=[B-[A\times(100-C)/100]]/[A\times(100-C)/100].$$

Wet Area Retention of Non-Woven Fabric (%):

A sample of 10 cm×10 cm of the non-woven fabric to be analyzed is dipped in water at 30° C. for 10 minutes. The sample is lightly squeezed to express water therefrom, and the dimension (cm) of the sample is measured both in the machine direction (A) and in the cross direction (B) thereof. The wet area retention of the sample is calculated according to the following equation:

$$\text{Wet area retention (\%)}=[[A\times B]/[10\times10]]\times100.$$

EXAMPLE 1

(1) A starting material for fibers, PVA having a degree of polymerization of 1750 and a degree of saponification of 97 mol % and copolymerized with 2 mol % of maleic anhydride was placed in a solution of DMSO, and dissolved therein with stirring at 240 rpm in a nitrogen atmosphere at 90° C. for 10 hours to prepare a spinning liquid having a polymer concentration of 20% by weight. Thus prepared, the spinning liquid at 90° C. was wet-spun through a spinneret having a number of orifices of 1500 and an orifice diameter of 0.16 mm, into a coagulation bath of methanol/DMSO in a ratio by weight of 70/30 at a temperature of 10° C. Next, the fibers were wet-drawn by a factor of 3.0 times, and extracted with an extracting solution of methanol at 25° C. to remove DMSO.

(2) Next, the fibers were dipped into a substitution bath of 3 g/liter of a cross-linking agent, dimethoxytetrahydropyran and 20 g/liter of an acid catalyst, maleic acid both dissolved therein, then dried in a nitrogen atmosphere at 150° C. for 8 minutes, and drawn by a factor of 2.0 times under dry heat at 170° C. The process gave PVA fibers having a fineness of 85,000 dtex, a strength of 4.5 cN/dtex and a degree of cross-linking of 0.09 mol %. The properties of the fibers are given in Table 1.

(3) 20 parts by weight of the PVA fibers obtained according to the method of production mentioned above, 30 parts by weight of rayon fibers (Daiwa Spinning's Corona, 1.7 dtex×40 mm) and 50 parts by weight of thermally-fusible fibers (Kuraray's PN716) were mixed and formed into a web. The web was needle-punched into a non-woven fabric. The fabric was then exposed to hot air at 130° C. The properties of the non-woven fabric are given in Table 2. The density of the non-woven fabric is 0.031 g/cm$^3$ and is low, and, in addition, its dimensional change when wet is small. This means that the fiber-to-fiber space in the non-woven fabric is sufficient, and the water retention ratio of the non-woven fabric is 14.0 times and is high.

EXAMPLE 2

Materials for non-woven fabric, 20 parts by weight of the PVA fibers in Example 1, 30 parts by weight of rayon fibers and 50 parts by weight of thermally-fusible fibers (Kuraray's PN716) were mixed and formed into a web. The web was embossed at 130° C. into a non-woven fabric. The properties of the non-woven fabric are given in Table 2. The composition of the non-woven fabric is the same as in Example 1, but the density thereof is 0.107 g/cm$^3$ and is high. Therefore, the fiber-to-fiber space in the non-woven fabric is small, and the water retention ratio of the non-woven fabric is a factor of 9.0 times.

EXAMPLE 3

(1) Fibers were spun in the same manner as described in Example 1, for which, however, a PVA starting material having a degree of polymerization of 1750 and a degree of saponification of 88 mol % was used. The PVA fibers obtained had a fineness of 85,000 dtex, a strength of 4.1 cN/dtex and a degree of cross-linking of 0.09 mol %. The properties of the fibers are given in Table 1.

(2) A web was formed of the PVA fibers alone, and then embossed at 140° C. into a non-woven fabric. The properties of the non-woven fabric are given in Table 2. The wet area retention of the non-woven fabric is 25% and is low, and the fiber-to-fiber space in the fabric is very small. However, since the fabric is formed of the absorbent PVA fibers alone, its water retention ratio is 12.0 times and is high.

EXAMPLE 4

Materials for non-woven fabric, 20 parts by weight of the PVA fibers in Example 3 and 80 parts by weight of rayon fibers (Daiwa Spinning's Corona, 1.7 dtex×40 mm) were mixed and formed into a web. The web obtained was treated with a water jet to form a non-woven fabric. The properties of the non-woven fabric are given in Table 2. The density of the non-woven fabric is 0.135 g/cm$^3$ and is high. Therefore, the fiber-to-fiber space in the non-woven fabric is small, and the water retention ratio of the non-woven fabric is 9.0 times.

EXAMPLE 5

Materials for non-woven fabric, 20 parts by weight of the PVA fibers in Example 3 and 80 by weight of thermally-fusible fibers (Kuraray's PN716) were mixed and formed into a web. Thus prepared, the webs were layered and placed in a mold, and processed therein at 130° C. to a non-woven fabric. The properties of the non-woven fabric are given in Table 2. The density of the non-woven fabric is 0.046 g/cm$^3$ and is low, and, in addition, its dimensional change while wet is small. This means that fiber-to-fiber space in the non-woven fabric is enough, but the ratio of the hydrophobic, thermally-fusible fibers is large. Therefore, the water retention ratio of the non-woven fabric is 9.5 times.

EXAMPLE 6

(1) A PVA starting material for the preparation of fibers, having a degree of polymerization of 1750 and a degree of saponification of 98 mol % and copolymerized with 1 mol % of itaconic acid was placed in water with 2 g/liter of glutaraldehyde previously added thereto, and dissolved therein with stirring at 240 rpm at 90° C. for 10 hours to prepare a spinning liquid having a polymer concentration of 15% by weight. The spinning liquid at 90° C. was wet-spun through a spinneret having a number of orifices (15000) and an orifice diameter of 0.16 mm, into an acidic coagulation bath of aqueous saturated Glauber's salt solution, in which the liquid coagulated and cross-linking occurred. The fibers obtained were drawn under wet heat to a roller draft of a factor of 3.0, then washed with water, dried at 130° C. and thereafter further drawn by a factor of 2.0 under dry heat at 170° C. The process gave PVA fibers having a fineness of 85,000 dtex, a strength of 3.1 cN/dtex and a degree of crosslinking of 0.07 mol %. The properties of the fibers are given in Table 1.

(2) 20 parts by weight of the PVA fibers, 30 parts by weight of rayon fibers (Daiwa Spinning's Corona, 1.7 dtex× 40 mm) and 50 parts by weight of thermally-fusible fibers (Kuraray's PN727) were mixed and formed into a web. The web was needle-punched into a non-woven fabric. The fabric was exposed to hot air at 170° C. The properties of the non-woven fabric are given in Table 2. The density of the non-woven fabric is 0.034 g/cm$^3$ and is low, and, in addition, its dimensional change when wet is small. This means that the fiber-to-fiber space in the non-woven fabric is sufficient, and the water retention ratio of the non-woven fabric is 14.0 times and is high.

Comparative Example 1

Fibers were spun in the same manner as described in Example 1, for which, however, the cross-linking agent dimethoxytetrahydropyran and the acid catalyst maleic acid were not used. Thus obtained, the PVA fibers had a fineness of 85,000 dtex and a strength of 4.5 cN/dtex. As in Table 1, however, the fibers almost completely dissolved even in water at room temperature since no cross-linking component was introduced thereinto, and therefore the fibers were not absorbent fibers.

Comparative Example 2

(1) A PVA starting material for fibers, having a degree of polymerization of 1750 and a degree of saponification of 99.9 mol % was dissolved in DMSO with stirring at 240 rpm in a nitrogen atmosphere at 90° C. for 10 hours to prepare a spinning liquid having a polymer concentration of 20% by weight. The spinning liquid prepared at 90° C. was wet-spun through a spinneret having a number of orifices (20000) and an orifice diameter of 0.1 mm, into a coagulation bath of methanol/DMSO in a ratio by weight of 65/35 at a temperature of 12° C. The material obtained was wet-drawn by a factor of 3.5, while being extracted with an extracting solution of methanol at room temperature to remove DMSO.

(2) Next, the drawn material was passed through a substitution bath of 40 g/liter of a cross-linking agent, dimethoxytetrahydropyran, dissolved therein, then dried in a nitrogen atmosphere at 150° C. for 5 minutes, and drawn by a factor of 4.4 under dry heat at 230° C. The drawn material was dipped into an aqueous solution of 80 g/liter of sulfuric acid at 75° C. for 30 minutes, and washed and dried. The process gave PVA fibers having a fineness of 66,000 dtex, a strength of 11.2 cN/dtex and a degree of cross-linking of 0.82 mol %. The properties of the fibers are given in Table 1. The fibers are highly resistant to wet heat and do not dissolve under wet heat. However, as is known from the melting point and the heat of fusion data of the PVA fibers measured by DSC, the fibers do not almost absorb water since their crystallinity is high, and they are far from the absorbent fibers of the invention.

Comparative Example 3

100 parts by weight of rayon fibers (Daiwa Spinning's Corona, 1.7 dtex×40 mm) were formed into a web, and the web was needle-punched into a non-woven fabric. The properties of the non-woven fabric are given in Table 2. In comparison to the non-woven fabrics of the PVA fibers of the invention, the absorbency of the non-woven fabric is poor.

TABLE 1

| | Degree of Crosslinking (mol %) | Fiber Strength (cN/dtex) | Water Absorption (times) | Solubility (%) | Melting Point (° C.) | Heat of Fusion (J/g) | Diameter Expansion Ratio of Fibers having absorbed water (times) |
|---|---|---|---|---|---|---|---|
| Examples 1 to 2 | 0.09 | 4.5 | 40.2 | 24.2 | 209 | 62 | 10.6 |
| Examples 3 to 5 | 0.09 | 4.1 | 20.1 | 22.3 | 202 | 54 | 9.8 |
| Example 6 | 0.07 | 3.1 | 19.6 | 25.3 | 212 | 66 | 8.6 |
| Comparative Example 1 | 0 | 4.5 | immeasurable (almost completely dissolved) | 100 | 183 | 49 | immeasurable |
| Comparative Example 2 | 0.82 | 11.2 | 2.8 | 1.5 | 242 | 117 | 1.0 |

TABLE 2

| | Blend Ratio of high-absorbent PVA fibers (mas.pt.) | Production Method for Nonwoven Fabric | Density of Nonwoven Fabric ($g/cm^3$) | Water Retention Ratio (times) | Wet Area Retention (times) |
|---|---|---|---|---|---|
| Example 1 | 20 | needle-punching + hot air | 0.031 | 14.0 | 98 |
| Example 2 | 20 | embossing + hot air | 0.107 | 9.0 | 90 |
| Example 3 | 100 | Embossing | 0.128 | 12.0 | 25 |
| Example 4 | 20 | wet-jet treatment | 0.135 | 9.0 | 105 |
| Example 5 | 20 | Molding | 0.046 | 9.5 | 100 |
| Example 6 | 20 | needle-punching + hot air | 0.034 | 12.0 | 100 |
| Comparative Example 3 | — | needle-punching | 0.038 | 7.0 | 100 |

EXAMPLE 7

(1) Using the same PVA polymer as described in Example 1, fibers were spun under the same conditions as in Example 1. The fibers were then wet-drawn by a factor of 2.5, while extracted with an extracting solution of methanol at 25° C. to remove DMSO.

(2) Next, the fibers were dipped into a substitution bath containing 10 g/liter of a cross-linking agent, tetramethoxysilane, and 1 g/liter of an acid catalyst, tartaric acid, dissolved therein. The fibers were then dried in a nitrogen atmosphere at 150° C. for 8 minutes, and drawn by a factor of 1.3 under dry heat at 180° C. The process gave PVA fibers having a single fiber fineness of 5.5 dtex, a water absorption of 60.7 times, a diameter expansion ratio of 11.7 times after having absorbed water, and a solubility of 100% at 98° C. The melting point of the PVA fibers obtained was 209° C., and the heat of fusion of the fibers was 62 J/g. Regarding the condensation number of the silane compound bonding to the PVA fibers, the proportion of n=3 and n=4 is large, and the Si content of the fibers was 625 ppm.

EXAMPLE 8

Fibers were spun in the same manner as described in Example 7, for which, however, the PVA material used had a degree of polymerization of 1750 and a degree of saponification of 88 mol %. The PVA fibers obtained had a single fiber fineness of 5.5 dtex, a water absorption of 25.6 times, a diameter expansion ratio of 9.9 times after having absorbed water, and a solubility of 99.8% at 98° C. The melting point of the PVA fibers was 202° C., and the heat of fusion thereof was 54 J/g. The fibers obtained were the same as those obtained in Example 7 with respect to the condensation number of the silane compound bonding to the fibers and of the Si content of the fibers.

In the invention for producing PVA fibers, a cross-linking component is introduced into a water-soluble PVA polymer in any stage ranging from the polymer dissolution step to the drying step. The invention enables the inexpensive production of PVA fibers which have good absorbency and have the necessary fiber strength for fibrous structures such as non-woven fabrics. When the cross-linking agent to be used is suitably selected, then the invention enables production of PVA fibers that are soluble in hot water and are biodegradable. The fibers are useful in the areas of use where the fibers are not incinerated for disposal and their biodegradability is required.

The non-woven fabrics comprising the PVA fibers are sufficiently absorbent for practical use. In addition, by suitably selecting the processing methods for the non-woven fabrics, dimensional control of the wet worked fibrous products is enabled, and the products are especially suitable in fields where they are required to have good adhesiveness.

The disclosures of Japanese priority applications Serial Nos. 253447/2002, 63203/2003 and 63204/2003 having filing dates of Aug. 30, 2002, Mar. 10, 2003 and Mar. 10, 2003 are hereby incorporated by reference into the present application.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. Cross-linked polyvinyl alcohol fibers prepared from a water-soluble polyvinyl alcohol, which satisfy the following requirements:

(1) a water absorption in water at 30° C. ranging from 10 to 100 times the weight of the fibers;

(2) a fiber diameter in water at 30° C. as a result of absorbing water ranging from 2 to 10 times the diameter of the fibers not having absorbed water; and (3) a melting point ranging from 160 to 220° C., and a heat of fusion ranging from 40 to 100 J/g.

2. The polyvinyl alcohol fibers as claimed in claim 1, which are cross-linked with a cross-linking agent that forms a cross-linked structure by hydrogen bonds and/or an ester bonds or ether bonds to the polyvinyl alcohol, and which have a degree of crosslinking of from 0.01 mol % to 1 mol %.

3. The polyvinyl alcohol fibers as claimed in claim 1, which are cross-linked by the introduction into polyvinyl alcohol of a silane monomer or oligomer of the following formula (1), or a polyacrylic acid or a salt of polyacrylic acid, and which dissolves to an extent of at least 90% in boiling water at 98° C.:

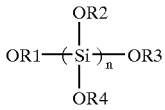

(I)

wherein $R^1$ to $R^4$ each independently represent hydrogen, an alkyl group having from 1 to 5 carbon atoms, or an acetyl group, and n ranges from 1 to 10.

4. The polyvinyl alcohol fibers as claimed in claim 1, which are prepared from PVA modified by monomer units which comprise at least 1 mole % of the PVA material.

5. The polyvinyl alcohol fibers as claimed in claim 4, wherein the modifying monomer units are selected from the group consisting of ethylene, allyl alcohol, itaconic acid, acrylic acid, vinylamine, maleic anhydride and its ring cleaved derivatives, sulfonic acid containing vinyl compounds, vinyl esters of fatty acids having at least 4 carbon atoms, vinylpyrrolidone and compounds of these monomers that are derived by partially or completely neutralizing the ionic groups therein.

6. The polyvinyl alcohol fibers as claimed in claim 1, wherein the fibers have a heat of fusion ranging from 40 J/g to 70 J/g and a melting point ranging from 160° to 210° C.

7. The polyvinyl alcohol fibers as claimed in claim 1, wherein the fiber diameter expands by a factor of from 4 to 8 times.

8. A method for producing the polyvinyl alcohol fibers of claim 1, which comprises:

introducing a cross-linking agent and/or a cross-linkable polymer into a water-soluble polyvinyl alcohol by reaction in a drying, drawing or heat-treating step, by dissolving the polymer in a spinning solvent or an extraction solvent in the presence of a catalyst in any stage of the polymer-dissolving step to the drying step, wherein the overall draw ratio of the fibers in the drawing step is a factor of at least 3 times.

9. The method according to claim 8, wherein the solvent by which a spinning liquid is prepared is water, DMSO, dimethylacetamide, dimethylformamide, N-methylpyrrolidone, a polyalcohol, mixtures of these solvents, mixtures of these solvents with a swelling metal salt and mixtures of an organic solvent of this group with water.

10. The method according to claim 8, wherein the polymer concentration in the spinning liquid ranges from 8 to 40%.

11. The method according to claim 8, wherein the polymer in the spinning liquid is spun into a coagulation bath containing a coagulation solvent under the condition of a weight ratio of coagulation solvent/spinning solvent ranging from 25/75 to 95/5.

12. The method according to claim 11, wherein the coagulation bath temperature is not greater than 30° C.

13. The method according to claim 11, wherein the coagulation solvent is an aqueous solution of a salt selected from the group consisting of Glauber's salt, sodium chloride and sodium carbonate.

14. The method according to claim 8, wherein the cross-linking agent is an aldehyde, an epoxy compound, a carboxylic acid an isocyanate or a silanol.

15. The method according to claim 8, wherein the aldehyde cross-linking agent is introduced into the polymer by a solution having an aldehyde concentration of 1 to 20 g/liter.

16. A non-woven fabric, which comprises the polyvinyl alcohol fiber of claim 1 and has a polyvinyl alcohol fiber content ranging from 5 to 100% by weight and an area retention while wet ranging from 20 to 120%.

* * * * *